United States Patent [19]

Reinhall

[11] 4,311,555

[45] Jan. 19, 1982

[54] METHOD OF MANUFACTURING FIBERBOARD

[76] Inventor: Rolf B. Reinhall, 834, 171 Place NE., Bellevue, Wash. 98008

[21] Appl. No.: 836,363

[22] Filed: Sep. 26, 1977

[30] Foreign Application Priority Data

Oct. 6, 1976 [SE] Sweden ..... 7611086

[51] Int. Cl.[3] ..... D21C 3/24

[52] U.S. Cl. ..... 162/206; 264/121; 162/190

[58] Field of Search ..... 162/13, 23, 47, 129, 162/205, 206, 207, 225, 201, 190; 264/121

[56] References Cited

U.S. PATENT DOCUMENTS

| | | | |
|---|---|---|---|
| 3,801,434 | 4/1974 | Carlsson | 264/121 |
| 4,012,279 | 3/1977 | Selander et al. | 162/13 |
| 4,046,622 | 9/1977 | Attwood et al. | 162/201 |

*Primary Examiner*—William F. Smith
*Attorney, Agent, or Firm*—Eric Y. Munson

[57] ABSTRACT

Method of producing fiberboard products according to the so-called dry method from lignocellulosic fiber material in which the fiber material discharged from a defibrating apparatus in an environment of steam is propelled in a stream of heated air to remove substantially all moisture therefrom. The thus dried fibers are deposited on an underlying moving perforated screen to form a mat in which the fibers are oriented at random while propellant air is evacuated therefrom. The thus formed mat is wetted by adding water thereto while it is being advanced by the screen into a hot press where the wetted fibers are compressed and bonded in their random orientation, with consequent removal of water. The amount of water added in the wetting step is proportioned to be effective in itself to bond the fibers without use of extraneous bonding or adhesive substance.

9 Claims, 1 Drawing Figure

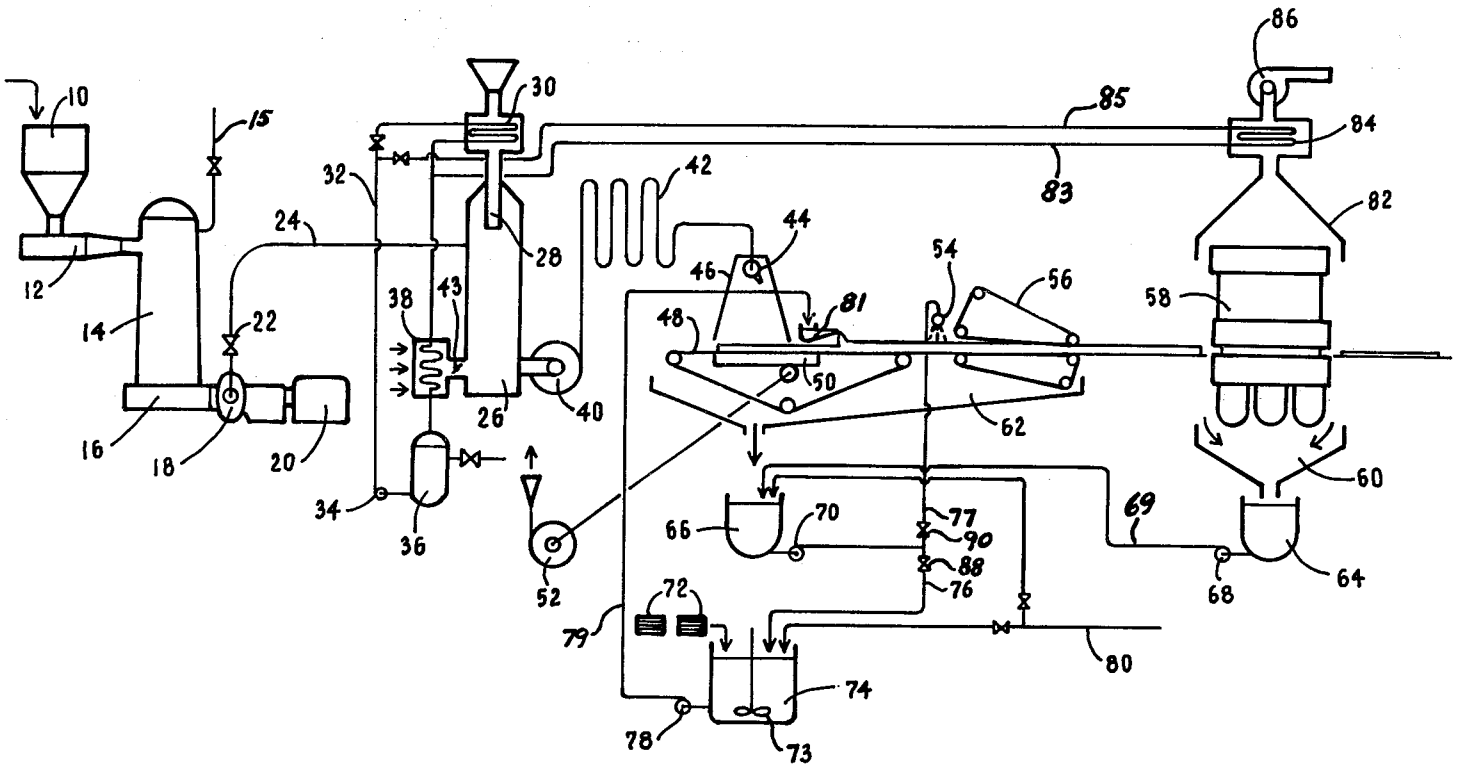
10
12
14
15
16
18
20
22
24
26
28
30
32
34
36
38
40
42
43
44
46
48
50
52
54
56
58
60
62
64
66
68
69
70
72
73
74
76
77
78
79
80
81
82
83
84
85
86
88
90

METHOD OF MANUFACTURING FIBERBOARD

BACKGROUND OF THE INVENTION

Manufacturing fibreboard by the existing method involves using the so-called wet method whereby the fibres are suspended in water which is then poured out on a screen so forming a sheet which is then given its final form in a hot press which also removes excess water. One disadvantage with this formation method is that when the fibres in the water suspension are spread out over the screen, a process which occurs relatively rapidly, the fibres end up lying along the direction of the path of the machine which results in a board in which the fibres are relatively oriented substantially in one direction. This results in variations in strength lengthwise and crosswise of the sheet and the board, which is disadvantageous.

In the production of boards according to the dry method, the sheet or mat is formed by suspending fine fibre particles in the air and depositing them on an underlying moving screen without any intermediate suspension in water. The so-called dry, half-dry or high-concentration forming methods result in a fibreboard in which the fibres are randomly oriented so that the sheet and the final board are equally as strong in all directions. However, one disadvantage with this method is that a bonding agent must be used to bind the fibres together, and this lengthens and complicates the process.

SUMMARY OF THE INVENTION

In order to eliminate the disadvantage inherent in the familiar methods described above, this invention contemplates a new high-concentration method for the manufacture of wet-pressed fibreboard which retains the advantages of the familiar methods while eliminating their disadvantages. This method is particularly well suited for converting existing conventional factories using the wet method. A further object of the invention is to provide a completely self-contained production process, thus eliminating the necessity of discharging waste and excess process water into lakes and watercourses.

These objects are realized according to this invention by wetting the layer of fibres once they have been desposited on the screen with a sufficient quantity of water so that it is essentially only the presence of the water in the final forming stage that gives the final board its necessary strength.

In terms of broad inclusion, the invention contemplates a modification of the so-called dry method of producing fiberboard, in which the dry mat prior to its advancement on the continuous screen into the conventional hot press is wetted with an amount of water just sufficient to bond the fibers in their random orientation in the mat without the necessity of adding any extraneous adhesive or other bonding substances which are normally required in the conventional dry method of fiberboard production.

Therefore, this invention retains the advantage afforded by the dry method, namely, random orientation of the fibre, while at the same time, the fibres are bonded by using water alone as the bonding agent, as in the wet method, to impart to the fiber board the requisite strength. However, in contrast to the wet method, the present invention provides strength and stability crosswise as well as lengthwise of the mat.

Furthermore, the forming technique taught by this invention may be combined with the conventional methods of manufacturing fibreboards in which the lignocellulosic material is disintegrated at a temperature of at least 100° C. and the energy supplied for the defibration and converted into steam generated in the processing of the fibres is separated and utilized to dry the fibres. The dryness is thereby raised to a level equal to or in excess of that which is imparted to the fibre mat in the compression step at the final stage of the process before the heat which is supplied at this stage dries the fibre mat to its final dryness by driving off the moisture in the form of steam.

BRIEF DESCRIPTION OF THE DRAWING

The FIGURE is a diagrammatic representation of a flow chart for a plant designed to perform the process according to the invention.

DETAILED DESCRIPTION OF AN EMBODIMENT OF THE INVENTION

In the practice of the invention, ligno-cellulose material, e.g. in the form of wood chips, is conveyed to a chip bin 10 from which a screw conveyor 12 or similar continually feeds the material into a pre-heater 14 in which the chip material is heated to a temperature suitable for the process, usually in the range of 130° C.–170° C., by steam supplied through a pipe 15. After preheating, the material is conveyed by means of a feeding device 16 to a grinder 18 where the heated material is disintegrated into separate fibres or clumps of fibres by grinding discs which rotate relative to one another. A motor 20 powers the grinder. The degree of fibre separation is adjusted according to requirements set for the final product. The fibres separated by the grinding discs are conveyed from the grinding housing, which is at a pressure above atmospheric, via a discharge valve 22 and a so-called blow-off pipe 24 by steam generated during defibration or supplied independently to a receptacle 26. The receptacle 26 is designed in such a way that the fibres and the steam are separated by the combined effects of centrifugal force and gravity. The separated steam is dispersed through an outlet pipe 28 either directly into the atmosphere or via a heat exchanger arrangement 30 so that the thermal energy in the steam can be recovered. This energy can be used for purposes outside of the process described herein, but it can also be used to heat the air which is used to propel the separated fibres to the place where they are formed into a sheet or mat as described below. The heat exchanger arrangement 30 is connected to a heat exchanger 38 by means of a pipe 32, a pump 34 and an expansion tank 36 for circulating the heat exchanger medium, e.g. water, air or the like. Air drawn in by the fan 40 passes through the heat exchanger 38 as shown diagrammatically by the arrows. After having been heated in the pre-heater 38, the heated air is passed through a pipe 43 into the receptacle 26 where it entrains the fibres collected therein and propels them by means of the fan 40 and the duct 42 to the mat forming station. The length of the duct is proportioned so as to allow for optimum utilization of the thermal energy transferred through the preheating device 38 to the air for drying the entrained fibres.

The duct 42 discharges into a dispenser 44 which is positioned at the upper section of a pyramid-shaped cowling or hood 46 whose lower section is situated over a moving screen 48 which is preferably perforated and through which the air supplied by the fan 40 via the dispenser 44 is evacuated into the atmosphere with the aid of a vacuum box 50 placed under the screen and a vacuum fan 52 connected to it. The fibres entrained in the stream are thereby separated and are deposited on the moving screen 48, forming a layer of fibres against the discharge side of the forming device, the surface weight of the sheet or mat being adjusted so that it is equivalent to the surface weight of the final fibreboard resulting from the process. In order to produce a fibre mat of optimum evenness without use of an excessive amount of water, a planing device is positioned immediately after the point where the sheet emerges from the forming hood 46. The planed away shavings are returned to the receptacle 26 or the dispenser 44 for reuse. By using the method described and shown herein, the fibres are positioned at random on the moving screen, thereby imparting to the mat and the final product substantially uniform strength lengthwise and crosswise of the fibreboard.

Upon formation of the mat, it leaves the forming station, represented by the hood 46—with or without planning. It is then wetted or sprayed, e.g. through the nozzles 54, with the amount of water required to enable the fibre sheet to be compressed and/or dried sufficiently so that it will acquire essentially the same properties of strength and stability as fibreboards produced according to the conventional wet process without the use of size or any other extraneous bonding substances. The fibre sheet thereby acquires a dryness of between 5% and 15%, which means that the sheet at this stage will have a fibre content between 95% and 85%. The fibre mat, having been sprayed with water, then passes through a conventional belt press 56 to compress the mat to the desired thickness, whereupon the mat, once it has been divided into sections (not shown), is conveyed into a hot press where the mechanical compression into fibreboards takes place, with consequent removal of excess water not required for the bonding of the fibres.

In the event the amount of water supplied by the nozzles 54 after the forming station 46 is such that the sheet's total water content exceeds the amount of residual water in the boards at the mechanical compression stage in the hot press 58, the water is pressed out of the fibre sheet when it is compressed in the hot press 58 to form boards. This water, together with any water which is extracted from the sheet when it passes through the press 56, if the amount of water applied was excessive, is drained into collection vessels 60, 62 and is piped to the subjacent water tanks 64 and 66 respectively. The water is pumped from the tank 64 via a pump 68 and a pipe 69 to the tank 66.

In certain cases it may be required that the surfaces of the finished boards be coated with fibres of another material. These are supplied as shown diagrammatically at 72 from a storage place of the material to a tank 74 equipped with a mixer 73 where the material is suspended in water which can be supplied e.g. via a branch pipe 76 from the tank 66 via a pump 70, and it is then conveyed after having been submerged in the tank 74 via a pump 78 and a pipe 79 to a so-called surface-coating box 81 of conventional type. The material in suspension, such as fibres, are thus deposited on the surface of the mat while the water passes through the mat and the subjacent perforated screen in the normal manner.

A pipe 80 is provided for the supply of fresh water to e.g. tanks 66 and 74 from a source (not shown) in order to maintain the necessary level of water in circulation and compensate for any possible water losses.

In the embodiment shown, the surface-coating box 81 is positioned between the hood 46 and the nozzles 54. Water is supplied to the latter from the tank 66 by a pump 70 through the additional branch pipe 77. Both the branch pipes 76 and 77 each have a regulating valve 88 and 90 respectively.

According to this invention, it is possible to return all the water recovered either to the surface-coating box 81, with or without the material in suspension, or to the nozzles 54. Possibly one of the devices 81 or 54 may be dispensed with.

Water is removed in the form of steam when the board is compressed in the hot press, and this steam can be collected in a hood 82 and its thermal energy can be utilized as a heat exchanger medium in heat exchanger 84 prior to being discharged into the atmosphere by a fan 86 or put to some other use. The heat exchanger 84 in the shown embodiment is connected to the heat exchanger coil of the receptacle 26 via the pipes 83, 85, but naturally the heat transferred can be used for other purposes if so desired.

It will be understood from the foregoing that this invention provides a process for manufacturing fibreboards which is similar to that used to manufacture the so-called wet fibreboards and which, from the point of view of quality and appearance, does not differ particularly from the conventional way of manufacturing fibreboards using the wet method with fibres suspended in water. However, the method of mat formation described herein produces a fibreboard with a greater Z-strength because the fibres which make up the mat in this process are not uniformly positioned in one dominant direction, and (it) thus completely eliminates the unavoidable variations in lengthwise and crosswise strengths which occur in fibreboards manufactured using the conventional wet method.

The method according to the invention eliminates the problem of pollution resulting from the discharge of the excess water pressed out of the mat formed according to the conventional wet method.

The above description is only one example of the realization of the invention. It can be varied in many ways within the framework of the following patent claims.

I claim:

1. The method of manufacturing fiberboard products according to the dry method from lignocellulosic moisture-containing fibers discharged from a defibrating apparatus, comprising the steps of:

(a) propelling the fibers in a stream of heated air to remove substantially all moisture therefrom, with consequent inactivation of the natural binders in the lignocellulosic fibers;

(b) depositing said dried fibers on an underlying moving screen to form a mat in which the fibers are oriented at random while removing propellent air therefrom;

(c) wetting said mat by adding water thereto while advancing it in its supported position on said screen without disturbing the random orientation of the fibers therein;

(d) advancing said mat further on said screen into a hot press to compress the wetted fibers and bond them together in their random orientation with consequent removal of water;

(e) the amount of water added at said wetting step being so coordinated to the dried fibers as to be effective by itself to bond the fibers in the hot pressing step without the addition of any extraneous bonding agent.

2. The method according to claim 1, in which water is added in the wetting step in an amount to impart to the mat a dryness ranging between 5% and 15%.

3. The method according to claim 1, in which the heat quotient of the mechanical energy input during the defibration step is utilized to heat the propellent air stream.

4. The method according to claim 3, in which the heat quotient in the form of superatmospheric steam is separated from the fibers upon discharge from the defibrating apparatus and recycled in heat exchange with the propellent air stream.

5. The method according to claim 4, in which steam generated in the hot pressing step is additionally recycled in heat exchange with propellent air stream.

6. The method according to claim 1, in which water added in the wetting step in excess of that required for bonding the fibers in the hot pressing step is removed by compression of the mat prior to its advancement into the hot press.

7. The method according to claim 6, in which free water removed in the hot pressing step is collected and recycled to the wetting step.

8. The method according to claim 7, in which excess water is additionally collected and recycled to the wetting step.

9. The method according to claim 8, in which a portion of the removed and collected water is utilized to produce a pulpable suspension of coating material for coating the dry mat.

* * * * *